United States Patent [19]

Ariel

[11] 4,354,676

[45] Oct. 19, 1982

[54] EXERCISER

[75] Inventor: Gideon B. Ariel, Belchertown, Mass.

[73] Assignee: Pepsico, Inc., Purchase, N.Y.

[21] Appl. No.: 949,237

[22] Filed: Oct. 13, 1978

[51] Int. Cl.[3] ..... A63B 21/24

[52] U.S. Cl. ..... 272/129; 272/130; 272/134

[58] Field of Search ..... 73/379; 272/93, 129–131, 272/134, 135, DIG. 1, DIG. 4–DIG. 6; 235/92 GA; 340/323 R; 364/410

[56] References Cited

U.S. PATENT DOCUMENTS

| | | | |
|---|---|---|---|
| D. 226,439 | 3/1973 | Coker | D34/5 K |
| D. 242,732 | 12/1976 | Brentham | 272/130 |
| 3,395,698 | 8/1968 | Morehouse | 272/DIG. 6 |
| 3,465,592 | 9/1969 | Perrine | 272/130 |
| 3,784,194 | 1/1974 | Perrine | 272/DIG. 1 |
| 3,848,467 | 11/1974 | Flavell | 272/129 |
| 3,858,873 | 1/1975 | Jones | 272/117 |
| 3,859,840 | 1/1975 | Gause | 73/379 X |
| 3,869,121 | 3/1975 | Flavell | 272/129 |
| 3,984,666 | 10/1976 | Barron | 73/379 |
| 3,989,240 | 11/1976 | Victor et al. | 272/134 |
| 3,998,100 | 12/1976 | Pizatella et al. | 73/379 |
| 4,063,726 | 12/1977 | Wilson | 272/DIG. 4 |
| 4,184,678 | 1/1980 | Flavell et al. | 272/129 |
| 4,235,437 | 11/1980 | Ruis | 272/129 |

OTHER PUBLICATIONS

"Computerized Dynamic Resistive Exercise", (Abstract) G. B. Ariel, 1976.

*Primary Examiner*—Richard J. Johnson

[57] ABSTRACT

An exerciser bar is supported for rotation and acts against an hydraulic cylinder with the angle of the bar and the pressure in the cylinder measured and fed to a micro computer which, using this input data, controls the cylinder pressure in accordance with a selected exercise program, the micro computer also providing outputs to displays so that the person exercising can monitor his progress.

32 Claims, 12 Drawing Figures

DATA ADDRESS & CONTROL BUSS

| | | | |
|---|---|---|---|
| GND | 1 | A | A11 |
| +5V | 2 | B | A12 |
| D5 | 3 | C | A10 |
| D7 | 4 | D | A13 |
| D6 | 5 | E | A9 |
| D4 | 6 | F | A14 |
| D3 | 7 | H | A8 |
| D2 | 8 | J | A15 |
| D1 | 9 | K | A7 |
| DØ | 10 | L | A6 |
| -12V | 11 | M | A5 |
| +12V | 12 | N | A4 |
| $\overline{\text{RAM SEL}}$ | 13 | P | A3 |
| | 14 | R | A2 |
| $\overline{\text{SEL 12}}$ | 15 | S | A1 |
| ROM EN2 | 16 | T | A0 |
| ROM EN1 | 17 | U | B.A. |
| $\overline{\text{VMA·Ø2}}$ | 18 | V | R/$\overline{\text{W}}$ |
| $\overline{\text{BUS Ø2}}$ | 19 | W | $\overline{\text{NMI}}$ |
| | 20 | X | $\overline{\text{IRQ}}$ |
| +5V | 21 | Y | $\overline{\text{HALT}}$ |
| GND | 22 | Z | $\overline{\text{RESET}}$ |

FIG. 4a

I/O BOARD

| | | | |
|---|---|---|---|
| GND | 1 | A | $\overline{\text{CW STEP}}$ |
| +5V | 2 | B | A12 |
| D5 | 3 | C | $\overline{\text{CCW STEP}}$ |
| D7 | 4 | D | A13 |
| D6 | 5 | E | MEM R/W |
| D4 | 6 | F | A14 |
| D3 | 7 | H | MEM Ø |
| D2 | 8 | J | A15 |
| D1 | 9 | K | MEM 1 |
| DØ | 10 | L | MEM 2 |
| -12V | 11 | M | A5 |
| +12V | 12 | N | A4 |
| $\overline{\text{RAM SEL}}$ | 13 | P | A3 |
| | 14 | R | A2 |
| $\overline{\text{SEL 12}}$ | 15 | S | A1 |
| ROM EN2 | 16 | T | A0 |
| ROM EN1 | 17 | U | B.A. |
| $\overline{\text{WMA·Ø2}}$ | 18 | V | R/$\overline{\text{W}}$ |
| $\overline{\text{BUS Ø2}}$ | 19 | W | $\overline{\text{NMI}}$ |
| | 20 | X | $\overline{\text{IRQ}}$ |
| +5V | 21 | Y | -5V |
| GND | 22 | Z | $\overline{\text{RESET}}$ |

FIG. 4b

MEMORY BUSS

| | | | |
|---|---|---|---|
| GND | 1 | A | GND |
| GND | 2 | B | GND |
| +5V | 3 | C | +5V |
| A11 | 4 | D | A10 |
| A9 | 5 | E | A8 |
| A7 | 6 | F | A6 |
| D5 | 7 | H | D7 |
| D6 | 8 | J | D4 |
| | 9 | K | |
| SEE TABLE | 10 | L | |
| | 11 | M | |
| MEM R/W | 12 | N | |
| MEM R/W | 13 | P | |
| | 14 | R | |
| D3 | 15 | S | D2 |
| D1 | 16 | T | DØ |
| A5 | 17 | U | A4 |
| A3 | 18 | V | A2 |
| A1 | 19 | W | AØ |
| +5V | 20 | X | +5V |
| GND | 21 | Y | GND |
| GND | 22 | Z | GND |
| SIGNAL | PIN | PIN | SIGNAL |

FIG. 4c

| PIN 10 USAGE | |
|---|---|
| SLOT | SIGNAL |
| 4 | MEM Ø |
| 5 | MEM 1 |
| 6 | MEM 2 |
| | |

TABLE A

| ADDRESS | DEVICE |
|---|---|
| D004 + D005 | DISPLAY |
| D008- D00B | PIA #ϕ |
| D010 | MOTOR CW |
| D020 | MOTOR CCW |
| D040 - D043 | |
| D080 - D083 | |
| D100 - D103 | |

TABLE B

| ADDRESS | DEVICE |
|---|---|
| EE08 + EE09 | ACIA |
| EE10 - EE13 | PIA #1 |
| EE20 - EE23 | PIA #2 |
| EE40 - EE43 | |
| EE80 - EE83 | |
| EF00 - EF03 | |

| FIG. 9A | FIG. 9B |
|---|---|

EXERCISER

BACKGROUND OF THE INVENTION

This invention relates to exercising devices in general and more particularly to a multi-purpose programmable exerciser device.

Various exercising devices have been developed for different purposes. A large number of such devices have as their purpose muscle building. However, there are also devices designed to improve cardio respiratory fitness and devices used for rehabilitation purposes.

Typical of body building devices are those described in U.S. Pat. No. 3,858,873 to Jones and U.S. Pat. Nos. 3,869,121 and 3,848,467 to Flavell.

U.S. Pat. No. 3,858,873 describes a weight-lifting exercise device in which the pull on the weight mass is continuously varied over a full range of rotation. The object is to provide a balanced resistance over the full range of motion of the involved body part and muscles. This is what is known as a variable resistance exerciser. Jones obtains his variable resistance using a weight and pulley system coupled to a bar which the user must lift, the bar coupled to the pulley system by means of a spiral. Due to the configuration of the spiral pulley, the tension of the cable which is coupled to the bar is constantly changed as the pulley is rotated between the limiting positions.

Flavell teaches the importance of a progressive resistance exercise, noting the need to increase diffficulty of the exercise from day to day and also noting the need to decrease the resistance as the user becomes tired. He also discloses a concept of variable resistance which incorporates a servo system and has a net effect "that, once the device reaches regulated speed, the harder the user pulls on the cable, the more resistance is afforded the user by the device and the exercise resistance is therefore variable in proportion to the instantaneous capacity of the user." The device includes a display for the user to view during the exercise. The system is programmable in that the user can preselect the desired speed of movement and acceleration and deceleration rates. In the system, the harder the exerciser works, the more force there is applied once he reaches his desired speed. The total amount of work for the given portion and for the total of the exercise are displayed. If the user gets more tired and applies less force, the force in the system which acts against him decreases and he does less work. Based on previous performance, the user sets a goal for himself as to a total amount of work and then by reading a performance dial tries to match or exceed the performance in a series of exercises, keeping less work.

Two other patents which relate to this type of device are U.S. Pat. No. 3,465,592 and U.S. Pat. No. 3,784,194 which operate in a manner similar to U.S. Pat. Nos. 3,869,121 and 3,848,467. U.S. Pat. No. 3,784,194 attempts to maintain a constant velocity. This is done through a mechanical/hydraulic type of system.

Also of interest are U.S. Pat. Nos. DES, 242,732 and DES, 226,439 both of which show the basic kind of exerciser to which the present invention is applicable and both of which utilize hydraulic cylinders of the same kind as used in the present invention.

A type of device utilizing a micro-processor is one sold under the name Dynavit which is adapted to maintain and improve cardiorespiratory fitness. This device, which is a bicycle type exerciser, permits selecting various inputs and monitors not only exercise but pulse rate, giving outputs indicative thereof.

Although each of these exercisers fulfills a certain purpose, all suffer from various disadvantages, the major one being a lack of flexibility. Each is adapted to perform in one and only one fashion. For example, a number of the exercisers described above operate only at constant velocity. Others operate with a constant force. In each case no other type of operation is possible.

Thus, the need exists for an exerciser which is adaptable to whatever type of exercise program is desired, be it constant velocity, constant force, constant acceleration or a program in which these quantities are varied. Furthermore an exerciser which can be adapted to not only body building but also cardiorespiratory training and rehabilitation is needed.

SUMMARY OF THE INVENTION

The present invention provides an exerciser which has a great deal more flexibility than the exercisers of the prior art. Not only does it permit programming for exercises used for different basic purposes, i.e., exercisers for muscle building, for rehabilitation and for cardio-pulmonary purposes, but it also permits carrying out a given type of exercise in almost any manner described. This is particularly important in the area of muscle building or training for specific athletic events. First, there is a great deal of difference of opinion between trainers as to how best to train. Some believe the trainee should work against constant forces when training. Others believe that constant velocity is preferable. Evidence exists that in actuality the best way to train is while maintaining constant acceleration. Beyond this, in training for certain athletic events, analysis has been done showing that a certain velocity profile, for example, is followed in the event. An example might be someone putting a shot. The force or weight of the shot remains essentially the same. However, in the movement of throwing the shot, velocities vary. In training for this event, on an exerciser, it would be desirable to program the exerciser with the same velocity profile. The present invention permits doing this. Another example is in the area of rehabilitation. Over a certain range of movement a person may be able to work against one force, but only a smaller force in a different range. The exerciser of the present invention can be specifically programmed in this manner to allow the person being rehabilitated to get the maximum advantage therefrom. Furthermore, the capability exists to modify the profile as the person being rehabilitated builds up his strength over a full range.

All of these possibilities are realized in a single exerciser the first element of which comprises means supported for movement between two limits for engagement by at least one limb of the user. Although only a single type of exercise device is shown, the present invention may be used with various types of exercisers which include a bar or the like which is capable of linear or rotational movement and which is used to practice, for example, exercises corresponding to those done with barbells. The exerciser may be adapted to be used with a single arm, single leg, two arms or two legs. As a practicular example, the exerciser of the present invention can use as the means for engagement by a user any of the types of exercisers illustrated in the two previously mentioned design patents. Secondly, the exerciser of the present invention includes means for controlling the movement of the first means by resisting a force applied thereagainst, the means having a control input. An example of this is the hydraulic cylinders shown in the aforementioned design patents. To this point, the exerciser is like those of the prior art. However, in addition to these two means just mentioned, the system of the present invention also includes means for measuring the force applied to the means for engagement by the user and providing an output proportional thereto, means for measuring the displacement of the these means between the limits and providing a second output proportional thereto and means, which are programmable, having these two outputs as inputs and providing an output coupled as a control input to the means for controlling movement of the first means, e.g., a valve in an hydraulic cylinder.

Stated another way, the improvement of the present invention comprises, in a type of device like that shown in the aforementioned design patents, measuring the force applied to the means against which the user acts to develop a first output, measuring the angular displacement of the means against which the user acts and providing a second output signal, storing desired values of quantities such as force, velocity or acceleration, comparing one of the output signals with the stored values and developing a control signal for the means such as the hydraulic cylinder such as to cause the measured output values to equal the desired values.

In its simplest form, the present invention simply includes means for setting in constant values or parameters such as force, velocity and acceleration and comparing them with the measured values, the angular position being differentiated once to obtain velocity and twice to obtain acceleration, and using these signals to develop an output signal. However, such does not give the complete flexibility mentioned above. As described, this is best accomplished by using a computer, preferably a microcomputer as the programmable means receiving the two output signals as inputs and developing an output in accordance with values which have been stored therein by the user. Even in a case where constant outputs are desired, i.e., a constant force, velocity or acceleration profile, the use of the microcomputer has a number of advantages. These include its ability to easily take into consideration any non-linearities in the system, including the effect of the weight of the means against which the user acts. Typically, this is an exercising bar supported for rotation on a frame. Depending on its position the amount of its weight which acts against the user varies. The use of a microcomputer permits storing tables of this function and automatically compensating for it as the bar is moved through an angle. Furthermore, it permits compensating for any non-linearities caused by location of the angular measuring devices.

Most significant, however, is the ability to have almost unlimited flexibility in storing a desired force, velocity or acceleration profile. This is accomplished by storing in the microcomputer an array of desired values for the parameter in question, a value being assigned to each of a plurality of increments of angular movement. The microcomputer then simply correlates the measured angles with the desired value of the parameter, compares that with the measured value of that parameter [or a value computed therefrom] and develops a control output in accordance with the difference. Thus, the angular input in this embodiment of the machine is of essential importance since it is used in generating all of the various profiles which it is desired to follow. In other words, as compared to a simple device, in which only a constant value is stored for use over the whole range of the instrument, a value is stored for each angular increment.

Various embodiments of the present invention are illustrated. In one specific embodiment, the exerciser itself, including the exercising bar against which the user acts, the frame and the means applying counter force to the exercising bar are quite similar to those disclosed in the aforementioned design patents. In other words, a hydraulic cylinder is used as the means resisting or applying a counter force to the exercising bar. However, whereas in the prior art the user had to manually control a valve on the hydraulic cylinder, in the present invention this is automatically controlled by an output from the computer. The force applied is obtained by measuring the pressure within the cylinder with a pressure transducer. The angle is measured by means of a shaft encoder. In the illustrated embodiment movement of the valve is controlled by means of a stepper motor, although other types of systems such as a servo system can also be used.

The microcomputer also provides the capability of displaying instructions to the user. In the disclosed embodiment a twenty character alpha numeric display is utilized. Through the use of scrolling techniques, lines of instructions can be given to the user. During operation of the machine the display is used to display the instantaneous measured force, angle and velocity. Naturally, the display can be used also to display acceleration or another parameter. To permit the user to communicate with the computer a key pad is used which is constructed using the minimal number of keys necessary and which includes numerical keys plus keys assigned to special functions associated with the machine. The microcomputer also has the capability of communicating with terminals, with other computers and with storage devices. In accordance with the specifically disclosed embodiment of the present invention the microcomputer communicates with a terminal including a typewriter or with a plotter to permit plotting out desired force versus angle, measured force versus angle, desired velocity versus angle and measured velocity versus angle. For plotting the values, the system averages data obtained over four cycles of the exercise.

The use of the microcomputer also provides capability of receiving data from external sources. Thus, the desired parameter arrays can be programmed from a tape or disc to give a profile desired for a particular types of training. In addition, recordings of the exerciser's performance on a given day can be made and fed back to the microcomputer on a succeeding day so as to gradually increase the difficulty of the exercise. Recordings are also useful for analysis and in this regard data may also be provided to a central computer. For example, in a health club this would permit one person to monitor a plurality of people exercising on different devices made in accordance with the present invention. Other possibilities exist, including programs for other purposes. When used in the home, the microcomputer can serve a dual purpose in that it can both operate the exerciser and be used as a personal computer. Specifically, with respect to fitness, the microcomputer can also be used to give the person using it dieting information and to permit him to enter in information concerning his daily activity and food intake. This information along with measured values obtained from his exercising can be used to provide the user with an indication of calorie intake versus usage.

What has been discussed above indicates the manner in which the system disclosed herein may be expanded. However, there are also applications for systems not having the degree of complexity that the specifically disclosed system has. One very simple embodiment is illustrated herein. However, it is thought that an embodiment which includes the microcomputer but which is programmable with constant parameters could be quite useful as a personal exerciser. In such an embodiment, rather than use a complex and costly alpha numeric display, simpler numerical displays can be utilized. Furthermore, programming can be accomplished by means of digital switches or the like to avoid the need for a keyboard and the decoding associated therewith. However, it is still advisable to retain the microprocessor structure along with the above-noted advantages which permit correcting for various factors such as non-linearities due the weight of the bar, etc.

BRIEF DESCRIPTION OF THE DRAWINGS

FIGS. 4*a*, *b* and *c* illustrate the assignment of signals on the buses of FIG. 1.

DETAILED DESCRIPTION OF THE INVENTION

Figure 1:
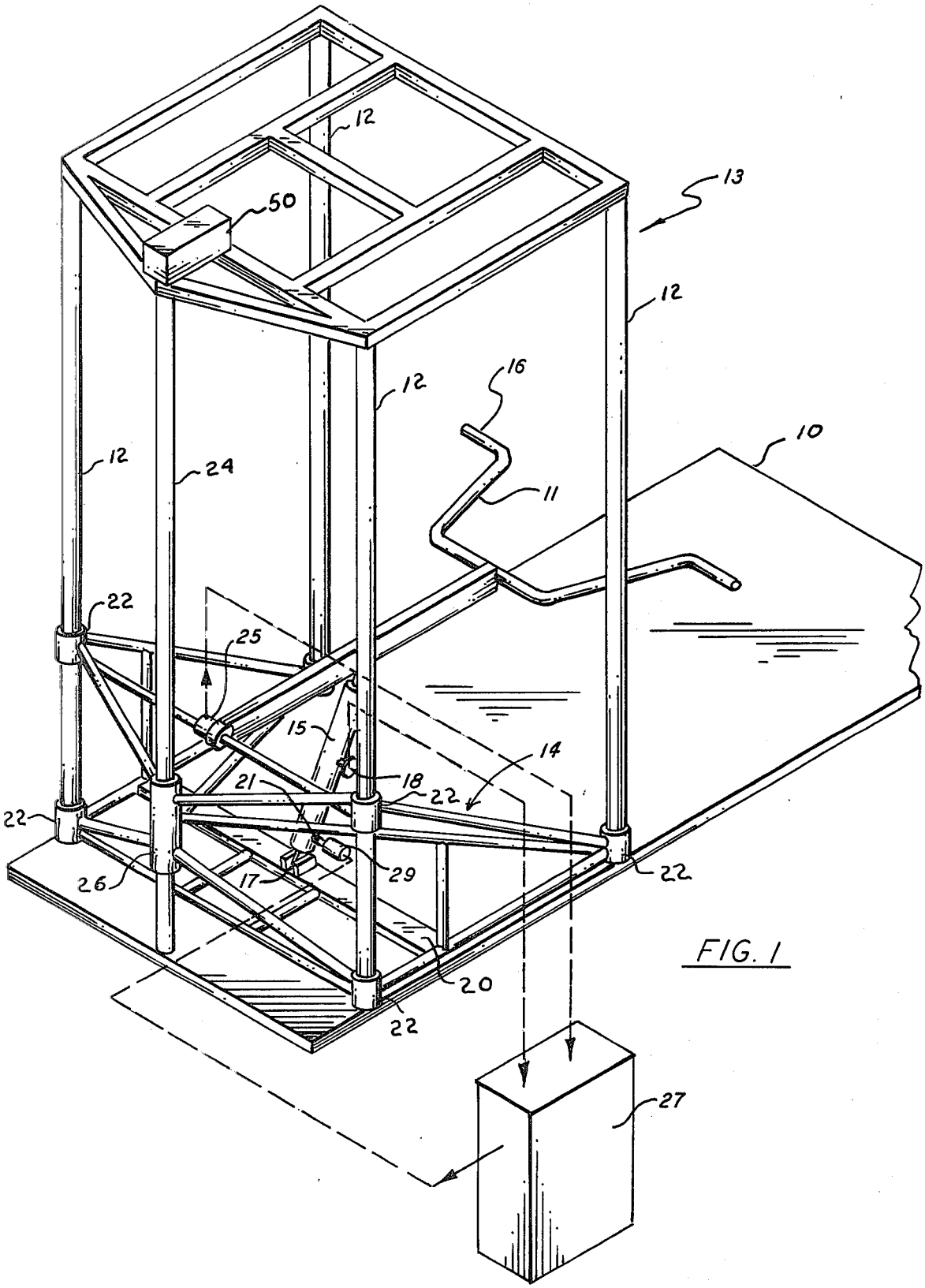
FIG. 1 is a perspective view of an exercise device constructed in accordance with the present invention.

FIG. 1 illustrates an exercising device constructed in accordance with the present invention. A set of movable handles 11, hereinafter sometimes referred to as an exercise bar, are rotatably disposed on a frame 13. The frame 13 has a fixed portion comprising four vertical shafts 12 secured to the base 10 and a movable portion 14 on which the exercise bar 11 is mounted. The exercise bar 11 supported on a base 10 has grips 16 by means of which a person doing exercises can grip the device to act against the force of an hydraulic cylinder and piston unit 15 which has its one end 17 rigidly secured to a strut 20 on movable frame 14 and its other end rigidly secured to the rotatable exercise bar 11. Movable frame is mounted to the shafts 12 using six oil impregnated bronze bearings 22. Up and down movement of frame portion 14 is by means of a threaded shaft 24 and threaded bearing 26. A drive motor 50 mounted to a support structure supporting shafts 12 and 24 drives shaft 24. This permits locating the exercise bar 11 for various exercises and adjusting it for the height of each individual. The amount of force which must be applied at the grips 16 is determined by the setting of a valve 21 in the cylinder. In prior art devices, such a valve was pre-set and the amount of force thereby determined. Any resetting of the force required a manual resetting of the valve. However, in accordance with the present invention, there is provided, coupled to the bar 11, preferably at its point of rotation about the frame 23, an angle transducer 25 which provides an output representative of the angular position of the bar 11. Mounted on the cylinder 19 is a pressure transducer 18. Outputs from the angle transducer 25 and pressure transducer 18 are inputs to a computer 27 which in turn provides an output to drive means 29 for positioning the valve 21. In this manner, the computer can be preprogrammed to control the force which must be applied at the handles 15 in almost any manner desired. For example, the valve can be controlled to maintain a constant force, constant velocity, or constant acceleration. Similarly, it can be programmed for a variable force as a function of angle. Some of the various possibilities will become more evident from the discussion below.

Figure 2:
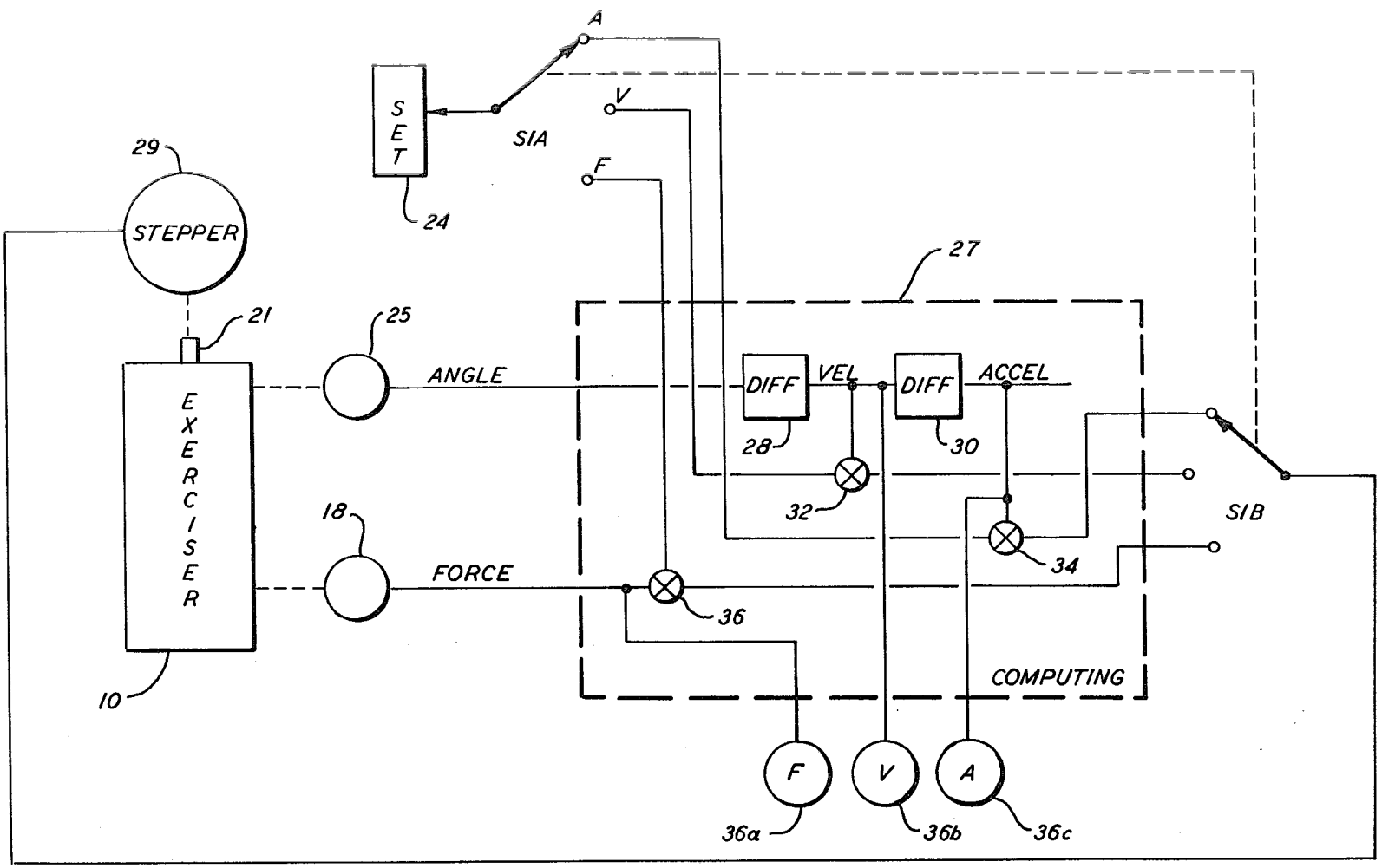
FIG. 2 is a block diagram of an exercise device constructed in accordance with the present invention implemented in analog fashion.

FIG. 2 illustrates a simplified form of the present invention. As indicated previously, there is coupled to the exerciser bar 11 an angle transducer 25 and a force transducer 18. The valve 21 is controlled by a stepper motor 29; this could instead be a servo motor. Furthermore, although FIG. 1 illustrates hydraulic control, control utilizing various types of motors, particularly those with a friction drive is also possible. The angle transducer 25 may be, for example a potentiometer and the force transducer 18 a pressure transducer each of which provide an output voltage proportional to angle and force, respectively.

In the simple embodiment shown in FIG. 2, programming is carried out by means of a setting means 24 and a switch having sections S1A and S1B, at the input and output, respectively of the computing module 27. For example, the setting means may comprise a potentiometer. Shown are the possibilities of settings for an acceleration, velocity or a force, whichever is desired. The angle input to the computing means 27 is differentiated once in a differentiator 28 to obtain a velocity signal and then differentiated again in a differentiator 30 to obtain an acceleration signal. The input labelled A, for acceleration, is compared or summed with the acceleration signal at a summing junction 34. Similarly, the input V is summed at a summing junction 32 with the actual detected velocity and the input F summed with the force input in a summing junction 36. The results of this are fed out through the switch section S1B as an input to the stepper motor 29. The stepper motor 19 will naturally have means associated therewith to convert a voltage signal into a stepper motor position. Alternatively, as noted above, the stepper motor can be replaced by a linear servo system. With this arrangement, which would preferably also include amplifiers and possibly some function generators to take care of non-linearities, the motor 19 is controlled in a manner so that the actual acceleration, velocity or force equals the desired acceleration velocity or force as set in at the setting means 24. Feedback to the user can be provided by meters 36*a*, *b* and *c* coupled to the force, velocity and acceleration signals respectively to give him instant feedback so that he can determine whether or not he is meeting the requirements he set for himself at the setting means 24.

Naturally, this system only gives the capability of providing constant force, velocity or acceleration. However, it can be expanded in such manner that it is possible to set in a velocity, force or acceleration profile. Naturally, such will require additional components.

For example, a plurality of programming resistors, providing different voltages along with appropriate switching means operated as a function of angle can be used. However, in order to get the desired flexibility and to be able to provide operation both with constant input parameters and variable parameters, it has been found that computing means in the form of a microprocessor are preferable. Such gives almost unlimited flexibility both with respect to the types of exercise profiles which can be programmed and with the ability to provide information to the user and, for that matter, to others who may wish to monitor him, along with providing the ability to make a permanent record of his performance for further analysis. Such a system is illustrated in block diagram form by FIG. 3.

Figure 3:
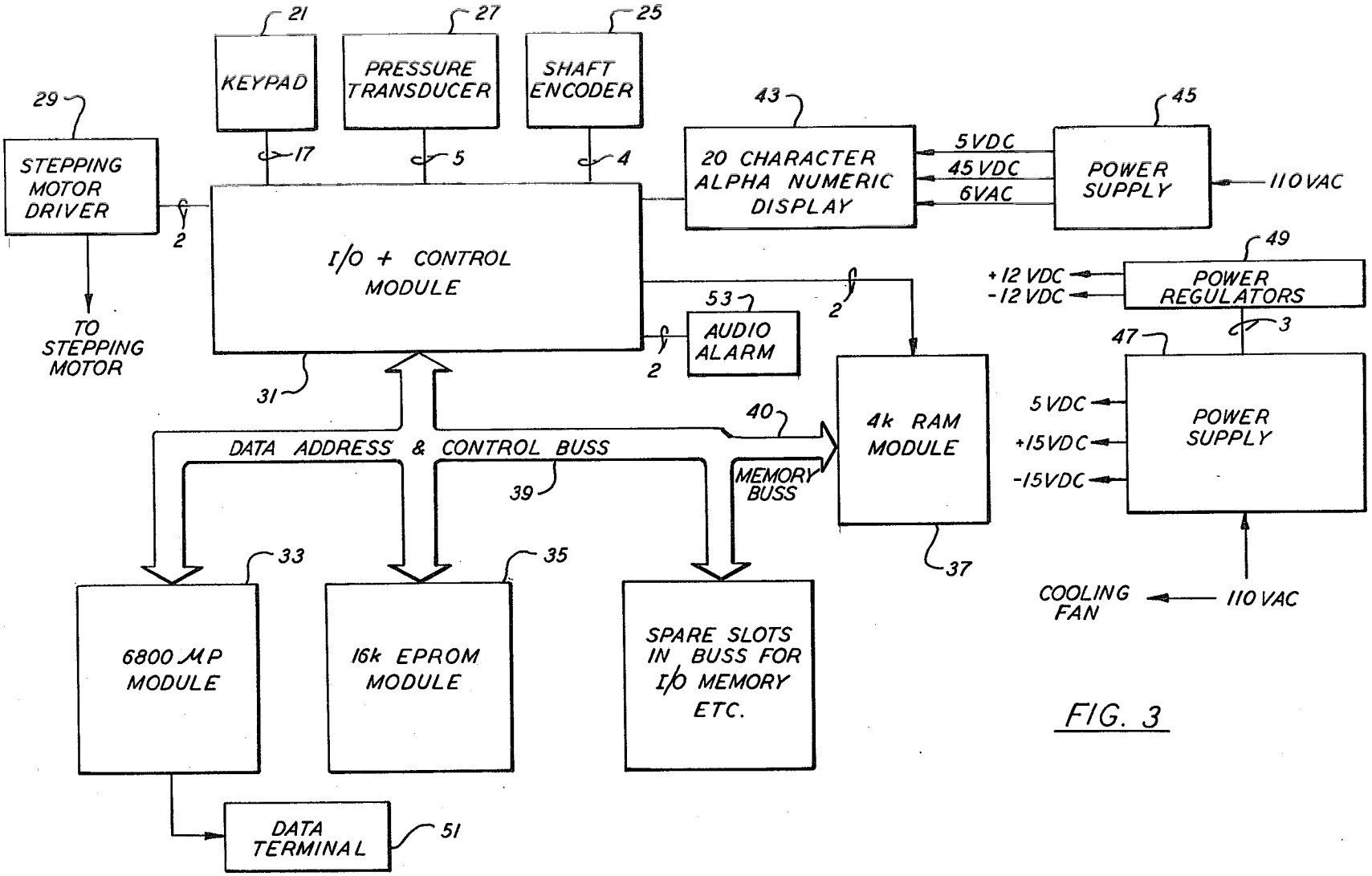
FIG. 3 is a block diagram of the system of the present invention implemented utilizing a microcomputer.

FIG. 3 is a block diagram of one system constructed according to the present invention. The computer comprises a microcomputer which includes an I/O and control module 31, a microprocessor module 33, a read-only memory 35, and a random access memory 37, interconnected by means of a common data, address and control bus 39 with the memory connected to a memory bus 40 having some lines in common with bus 39. The I/O and control module 31 receives inputs from the pressure transducer 18, the angle transducer 25, for example, a shaft encoder and provides outputs to the drive 29, for example, a stepping motor. The system also receives inputs from a key pad 41 which permits the user to set in the type of exercise he desires and provides outputs to an alpha-numeric display 43 to aid in the interaction of the user with the computer. Power supplies 45 and 47 are provided, along with a power regulator 49 coupled to the output of power supply 47 to supply the various voltages needed in the system. Although, various elements can be used, it has been found that a pressure transducer model AB from Data Instruments, Inc. works well as pressure transducer 18. Similarly, the shaft encoder may be one made by Theta Instruments under the part No. 05-360-1 which outputs 360 pulses per revolution. Because the nature of the exercise bar 11 is such that the hydraulic cylinder will allow it to go to its lowest position when it is released, on start up, the computer can determine that the device is in the initial position, and thus the only information required from the shaft encoder are pulses indicating an angular change. This information can then be counted or integrated within the computer to keep track of the exact angle. The particular stepping motor used is one available from Superior Electric which comes equipped with a translator for converting 12 volt pulses into proper drive signals for the motor. This type of device operates by receiving counter-clockwise and clockwise pulses as required with the translator converting the pulses into position signals.

Also shown on FIG. 3 is a data terminal 51 which can be plugged into the micro-processor module 33 to permit printouts and plotting of information. The particular microprocessor used is a Motorola 6800 $\mu$P one processor board obtained from Wintek Corporation. The read-only memory used is an E-Prom 16K module also from Wintek. The random access memory is a 4K RAM module obtained from Atwood Enterprises and the I/O control module one of special design to be discussed in detail below. The key pad 41 is a 16-key key pad available from Cherry. Also provided is an audio alarm 53 manufactured by Mallory. This is what is sold by Mallory as Sonalert, and is used for attracting the user's attention. It should be noted, that although specific microcomputer components from various manufacturers have been used herein, that other microcomputer components can equally well be utilized.

FIGS. 4*a, b* and *c* illustrate the various signals which are carried on the data, address and control bus. As shown, there are 44 lines, half of which are designated by numbers and half by letters. On the left hand side it will be seen that the first two lines are ground and plus 5 volts, as are the last two lines. Following these power lines are data lines $\phi$-7 followed by plus and minus 12 volt lines. Associated with line 13 is $\overline{\text{RAM SEL}}$; with line 15, $\overline{\text{SEL 12}}$; with line 16, ROM EN 2; with line 17, ROM EN 1; with line 18, $\overline{\text{VMA}\cdot\phi 2}$ and, with line 19, $\overline{\text{BUS}\phi 2}$. Associated with the letters are the 16 address lines, a signal BA, a signal R/$\overline{\text{W}}$, a signal $\overline{\text{NMI}}$, a signal $\overline{\text{IRQ}}$, a signal $\overline{\text{HALT}}$ and a signal $\overline{\text{RESET}}$.

FIG. 4*b* shows the I/O Board designations and FIG. 3(*c*) the memory bus designations. The various signals provided on these lines and their uses will become more apparent in the discussion below and, for that matter, use nomenclature well known to those skilled in the art. In general, in examining the I/O board connections, it will be seen that it is connected up in the same way as the data address and control bus with a few exceptions. Pins which are not used in the I/O module are assigned to other functions. For example, pins A and C are used to provide the outputs to the stepper motor; pin E is used to provide a memory read/write output; pins H, K, and L to select one of the 3 memories, and pin Y to supply minus 5 volts. The signals on the memory bus shown by FIG. 4C are all obtained from the data address and control bus or from the I/O board. Because a module from a different manufacturer was used, there is not a 1 to 1 correspondence between the pin numbers of FIGS. 4*a* and *b* and FIG. 4*c*. However, it can be seen that the signals are all signals present at the other locations.

FIGS. 5A–E illustrate the I/O module 31 along with some of the modules with which it communicates. The first module of interest is display 43. It has a set of 8 data lines which are connected directly to the data bus. Display 43 receives a write signal, WR and a read signal, RD. Display 43 is of the nature that it is possible to write into it and to also read back what is written. It has one address line that is buffered through a buffer 101. This address line is used to determine whether the data register or control register in the display is addressed. If the data register is selected, the display 43 continues to accept characters. If the control register is accessed, it is possible to position a cursor and cause the display to scroll and so forth. The display is selected by its chip select input, CS. The chip select input to display 43 is obtained from a NAND gate 103 which has as inputs the signal SEL 13 and the signal A2 coupled through an inverter 105. When these two bits are present with the proper polarity, the chip is selected.

The output of the pressure transducer is provided as an input to an analog to digital converter 107 which converts the analog signal from the pressure transducer to a digital output. The analog to digital converter 107 also supplies the necessary voltages to the pressure transducer. Analog to digital converter 107 provides 10 data lines of output. It also accepts a start signal which starts a conversion, a certain period of time after which the result is available at the output. In the present system, the timing for the conversion is done in the computer so that a pre-determined period of time, e.g., 6 milliseconds, after a start signal is given, data is read out. The data from analog to digital converter 107 is an input to a peripheral interface adaptor 109. Also, communicating with this port is the key pad 41. The key-pad has 16 keys which simply make a closure between a common and a given line, with the common connected to ground. The 16 outputs of the key pad are coupled into two priority encoders 111 and 113. The encoders need not have the priority feature, but in the present case these were the most convenient to use. Each of the priority encoders converts 8 inputs into a 3-bit code. The outputs of the two encoders 111 and 113 are cascaded in NOR Gates 115 through 118. The result of this conversion is a four-bit code, the outputs of which are designated K0, K1, K2 and K3. These are inputs to the input/output port 109. The output of gate 115 is used to simply indicate that a key has been pressed.

The shaft encoder provided outputs on two lines, the outputs being 90° out of phase with each other. These outputs are inputs to comparators 119 and 121. The shaft encoders produce a signal which is roughly a sine wave with a minimum of about 50 millivolts and a maximum of about 150 millivolts. Comparators 119 and 121 shape the sine wave into square waves with the proper voltages and polarities. The output of each of the comparators 119 and 121 is coupled through a buffer 123 or 125 respectively. The output of the buffer 123 is coupled into a one-shot multi-vibrator 127 which responds to a positive going pulse and the output of the buffer 125 into a one-shot multi-vibrator 129 which responds to a negative going pulse. The output of buffer 125 is also provided as one input to an AND gate 131 and as one input to an AND gate 133, at the inputs of one-shot multi-vibrators 135 and 137 respectively. The second input of gate 133 is the output of the one-shot 127 and the second input of Gate 131 the output of the one-shot 129. One-shots 127 and 129 give a 1 micro-second wide pulse. This in effect decodes the outputs of the shaft encoder so that an output will appear from one-shot 135 for a clockwise a pulse and out of one-shot 137 for a counterclockwise pulse. The two signals are Ored in a gate 139 to provide an output which indicates simply that an encoder pulse has occurred.

Also included in the I/O control module is the address decoding. Of the 16 address bits, the four most significant are used to define 16 4-K sections of memory. Thus, these address lines are inputs to a decoder 141 which is a 4 to 16 line decoder. Not all of the lines are used. However, as indicated, it can be seen that there are output lines to select memories 0, 1 and 2, $\overline{\text{RAM SEL}}$, $\overline{\text{SEL 12}}$ and $\overline{\text{ROM EN2}}$. Also provided are outputs $\overline{\text{SEL 13}}$ and SEL 13. The four address lines are each buffered through a buffer 143 at the input, and the outputs which are required to not be inverted are inverted through an inverter 145 at the output. The decoder is enabled by an input $\overline{\text{VMA}}\cdot\phi 2$.

Figure 6:
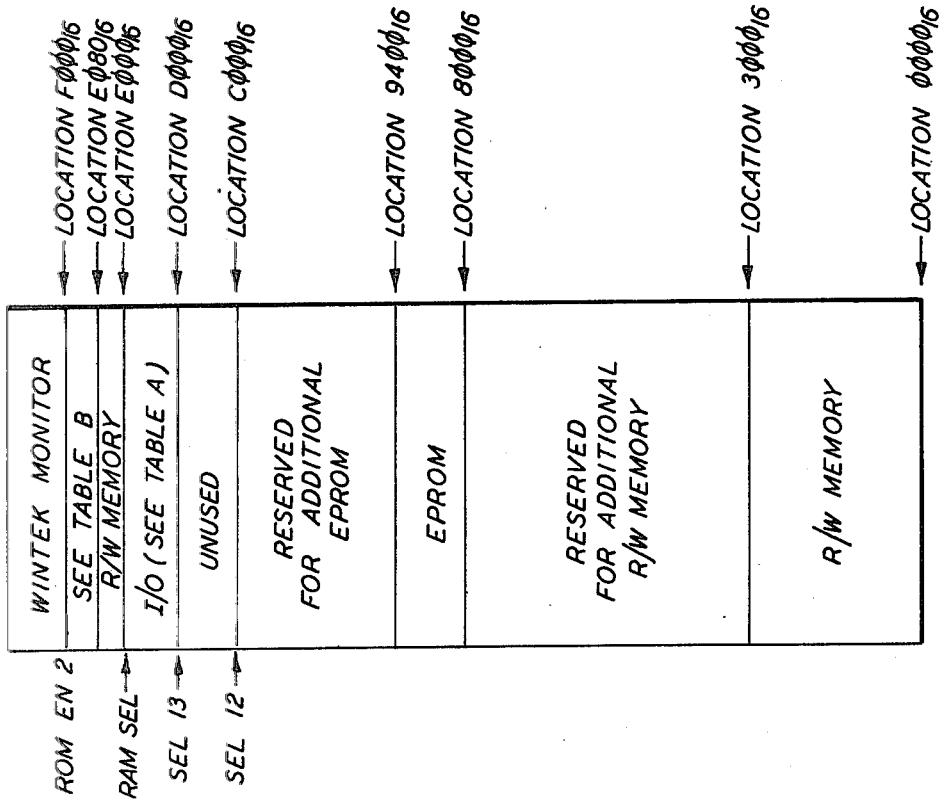
FIG. 6 is a diagram illustrating memory assignments.

This signal is low only during 2, which is the transfer part of the cycle, and when there is a valid memory address, i.e., when there is an indication from the processor that the address is valid and not just garbage. Memory $\phi$, 1 and 2 select the 3, 4-K memories of which only one is presently installed and the signals SEL 12 and SEL 13 select to input-output devices. The possible memory selections are set out in memory map of FIG. 6.

Since there are sixteen address bits, addresses are expressed in hexadecimal notation. As can be seen from FIG. 6, at location 0000 the read-write memory begins. Beginning at location 3,000 there is space reserved for additional read-write memory. Between locations 8,ϕϕϕ and 9,4ϕϕ is the erasable prom memory, with locations between 9,4ϕϕ and Cϕϕϕ reserved for additional read-only memory. The next section is unused and is enabled by the signal SEL 12 as indicated on the lefthand side. The next section, locations Dϕϕϕ to Eϕϕϕ, is the I/O with the specific addresses listed with respect to the device with which they are associated on Table A. The next section, between locations Eϕϕϕ and Eϕ8ϕ, is read-write memory and is enabled by the signal RAM SEL. Locations Eϕ8ϕ to Fϕϕϕ are also enabled by RAM SEL and the devices with which they assigned are set out in Table B. As is evident, many of these locations in the particular design disclosed herein are unused. This allows for expansion. The remainder of the locations above F000 are enabled by ROM EN2 and are associated primarily with a monitor which is used only for de-bugging purposes, and, thus, is not part of the exerciser system of the present invention.

Returning to FIG. 5, it will be seen that the $R/\overline{W}$ signal is an input to an inverter 151. It is also an input to a buffer 153 at the output of which there is a signal $I\text{-}R/\overline{W}$, the internal read-write signal. This signal is also buffered through a buffer 155 to provide an output labelled MEM/RW. The output of the inverter 151 is one input to an AND gate 157 with inverted inputs. The second input to gate 157 is from a switch 159, the output of which is ROM EN1. The output of gate 157 is one input to a NAND gate 159 receiving as its second input the signal ROM EN2. The output from gate 159 is an enabling input to a plurality of amplifiers 161 each coupled to a respective data line. The bottom two of the amplifiers are coupled to data lines D0 and D1. These, along with the amplifiers coupled to the data lines D4, D5 and D6 are coupled to ground. The buffer for D2 is coupled to the output of an AND gate 163 with inverted inputs and the input to the buffer 161 for D3 is coupled to the output of an AND gate 165 with inverted inputs. The buffer 161 for D7 and is coupled to the output of an inverter 167 having as an input the address line A0. This is also one input to each of the two NAND gates 163 and 165. NAND gate 163 obtains its second input through an inverter 169 from the A1 address line. Similarly, the second input to gate 165 is the A2 address line through an inverter 171.

With switch 159 in the test position, a pull-up resistor keeps ROM EN1 at a plus 5 volt level, thereby, when ROM EN2 is available, enabling the monitor to carry out testing. When the switch is in the normal position the circuitry just described is used to generate a re-start address when the signal $R/\overline{W}$ is high, indicating a read operation. This signal, after inversion, will be low at the input to gate 157. With this low input, and a low input from switch 159, the output of gate 157 will be high. It is then Anded with ROM EN2 to enable the buffers 161 to generate the re-start address. Since the data bus is only 8 bits and an address requires 16 bits this must be generated in two segments by using different combinations of the input A0, A2, and A1. This address directs the computer where to go to start up operation. In addition to the re-start address, there are also addresses which are generated when an interrupt occurs, when a non-maskable interrupt occurs and when a software interrupt occurs. This is a total of four addresses.

The three bits, A0, A1 and A2 are used to generate these addresses. Each of the addresses are spaced apart by four locations to permit inserting additional instructions. It will be recognized that the circuitry will respond to any address in the upper 4K of memory because it is selected by ROM EN2. However, the rest of the block of memory is unused so it doesn't matter if it responds to several addresses.

Figure 5B:
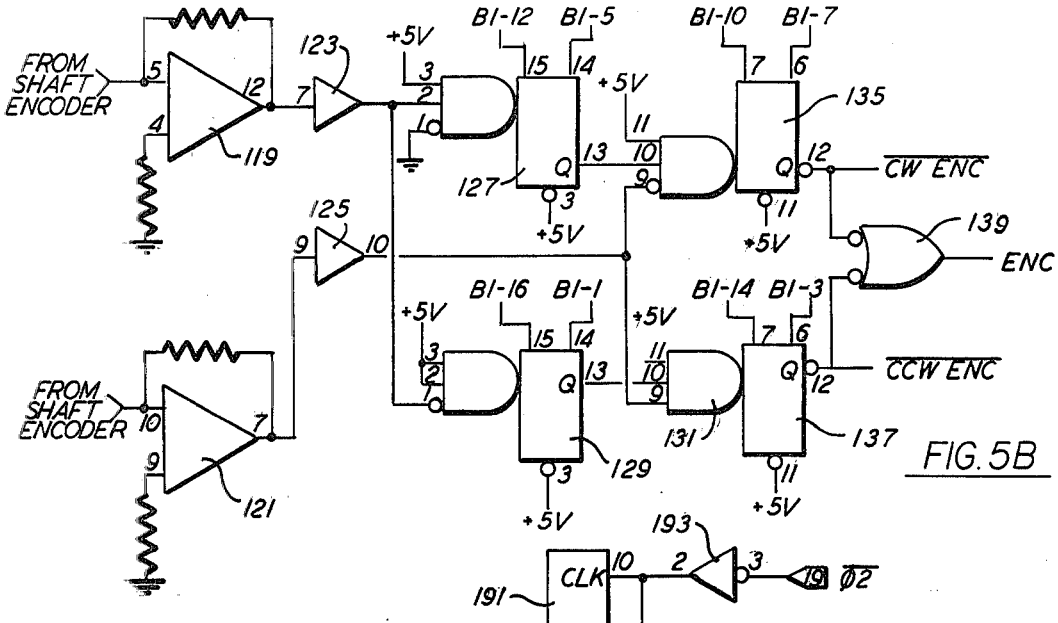
FIGS. 5A–E are block-logic diagrams of the I/O and control module of FIG. 3.
Figure 5A:
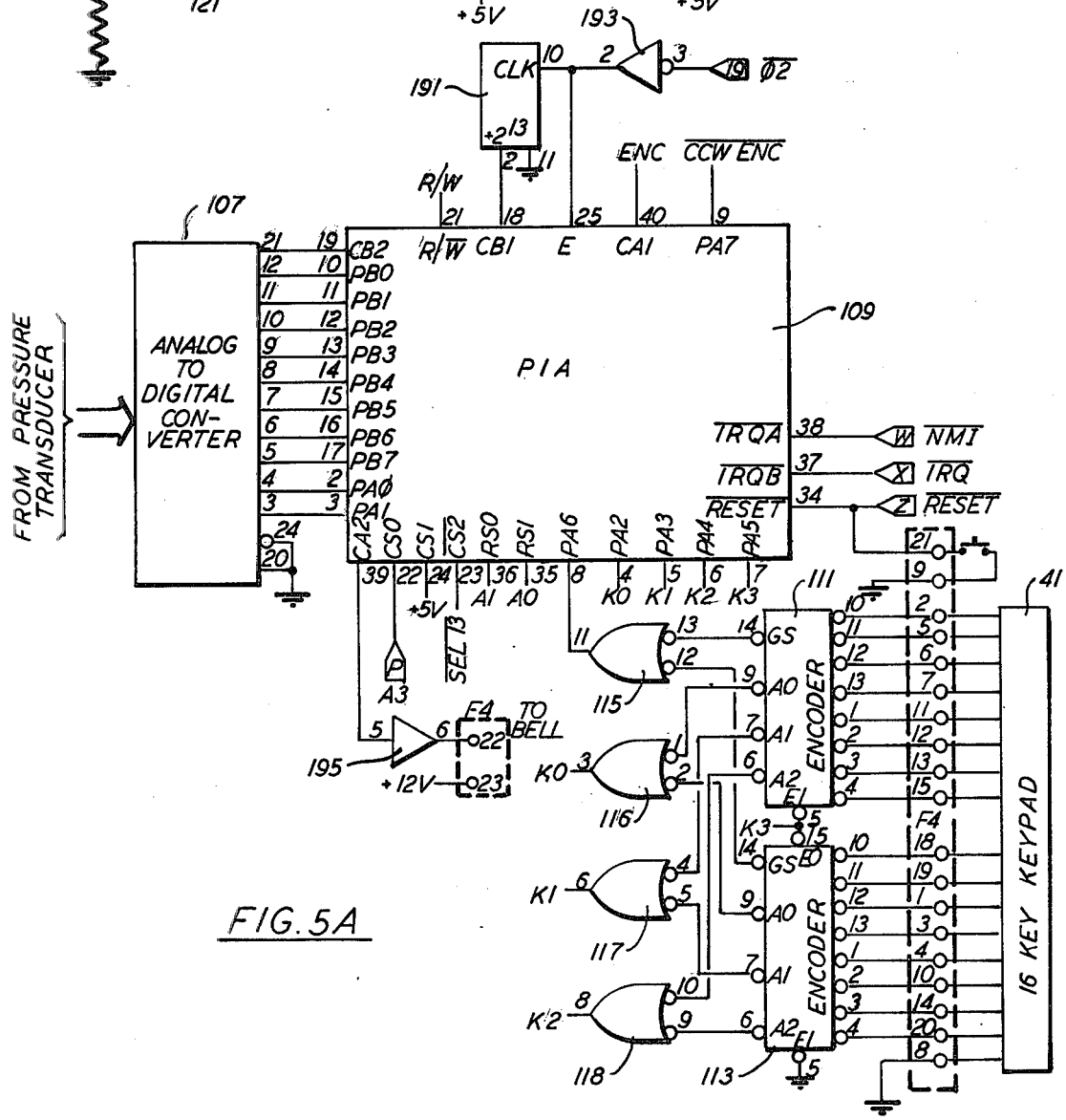
Figure 5C:
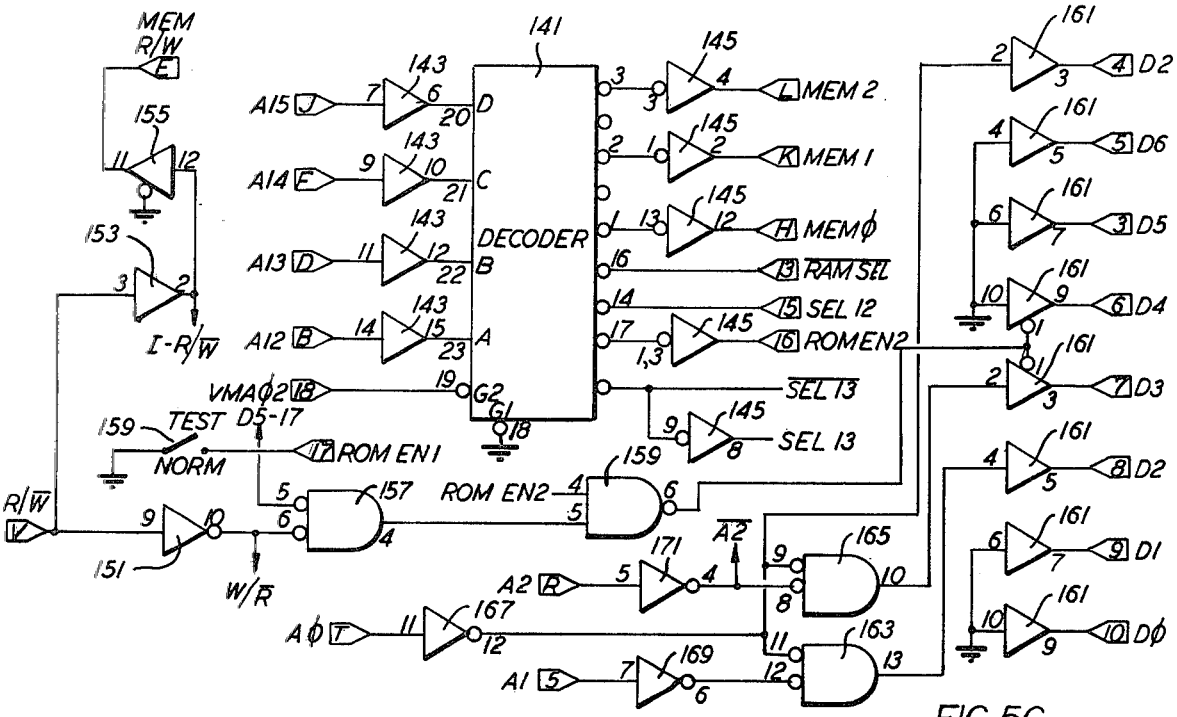
Figure 5D:
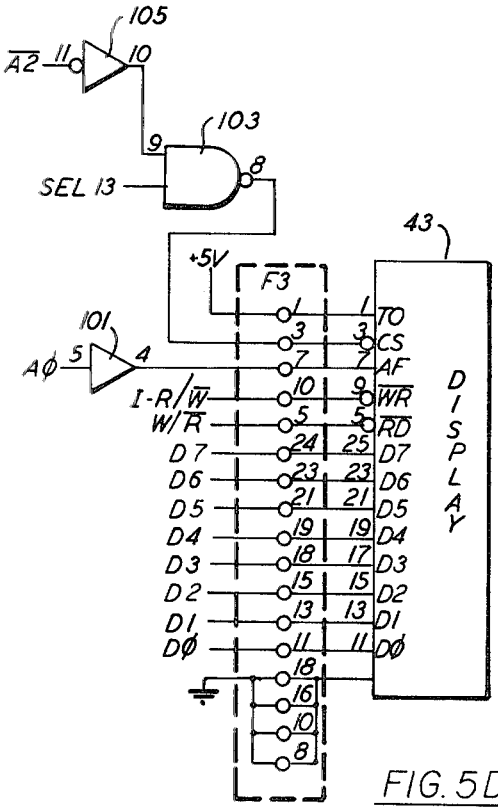
Figure 5E:
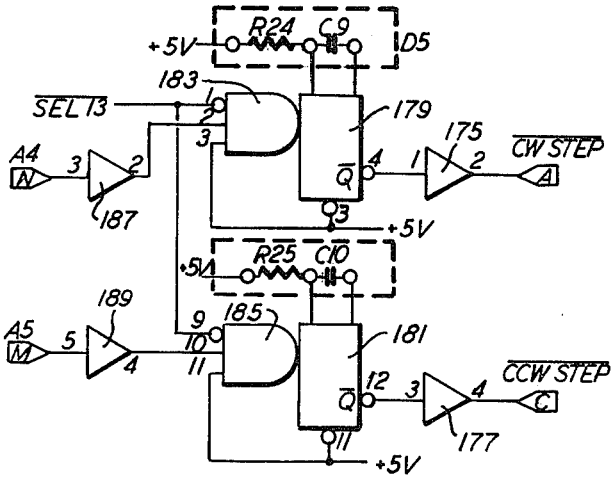

In FIG. 5E is the circuitry for driving the stepper motor. The stepper motor receives output from buffers 175 for a clockwise step and 177 for a counter-clockwise step. The signals being output are the inverted signals. These signals are obtained from one shot multivibrators 179 and 181, respectively. The inputs to the multivibrators are through AND gates 183 and 185, respectively. Each of the AND gates has an inverted input which receives as an enabling input signal the signal $\overline{SEL13}$.

With reference to the FIG. 4, it can be seen that $\overline{SEL13}$ is used to select input/output and that the addresses assigned to the clockwise and counterclockwise outputs are D010 and D020. This corresponds to the address bits A4 and A5. Thus, the address bit A4 is coupled through a buffer 187 as a second input to the gate 183 and A5 through a buffer 189 as a second input to a gate 185. The one shots are adapted to generate a 200 microsecond pulse which is the input to the translator associated with the stepper motor.

The peripheral interface adapter 109 has as an input the signal $R/\overline{W}$ obtained from the buffer 153. The second input to the adapter 109 is a clock signal obtained from a binary counter 191 which divides the 2 clock signal of the microprocessor, after being coupled through an inverter 193, by $2^{13}$. This generates the basic timing signal for the software which occurs roughly 15 times a second, as will be evident to those skilled in the art examining the program listing attached hereto. The adapter 109 contains two 8 bit ports which can be connected to external devices. Each port can be an input port or an output port selectable by the software. The two 8 bit ports are designated A and B.

As will be seen from examination of the figure, the most significant two bits out of the analog to digital converter 107 are coupled to inputs PAO and PAI, i.e., the first two bits of the A port. The remaining bits from the digital to analog converter 107 are connected to the B port, giving a total of ten bits being input. The adapter 109 also has two handshake signals for each side. For side B these are CB1 and CB2. The CB2 signal is used to provide the start output to the converter 107. The CB1 input, which is the control input for the B side, is coupled to receive the clock input from the counter 191. On the A side, the input CA1 is coupled to the Encode output from gate 139. The module is set up so as to generate an interrupt each time the positive edge of the clock input is detected. Similarly, an interrupt is generated each time there is an Encode signal at the input CA1 indicating that the shaft Encoder has moved. One of the data ines on the A side is connected to the counterclockwise pulse output from the Encoder circuitry. The clockwise pulse is not connected. Thus, when an Encoder signal occurs generating an interrupt, it is possible for the program to check to see if counterclockwise is set. If it isn't set, the program assumes that the movement was clockwise. These two interrupts just mentioned are the interrupts $\overline{IRQA}$ and $\overline{IRQB}$, which after being output are designed $\overline{NMI}$ and $\overline{IRQ}$. In other words, the output from the A side indicating an Encoder pulse is coupled to the non-maskable interrupt and the clock interrupt coupled to the interrupt line IRQ. The interrupt generated by the Encoder is coupled to the non-maskable interrupt since it is not desired to lose track of position at any time. Furthermore, the program must look at the output from the one shot 137 within 70 microseconds of the interrupt. The other interrupt, which is the normal interrupt request, can be masked since it does not matter if it is serviced each time the clock pulses. The adapter 109 utilized herein is one available from Motorola and is described in detail in the Motorola Microprocessors Applications Manual.

The control line CA2 is coupled through a buffer 195 to the Sonalert. The output from gate 115 which indicates that a key has been activated on the keyboard 41 is coupled into the data line PA6. This does not generate an interrupt. This is checked each time a clock interrupt occurs. Because the response time of the hand is not fast enough to press a key and release it between clock interrupts, this is all that is necessary. The four data signals, K0, K1 and K2 from the gates 116, 117 and 118, along with the signal K3 from the encoder 111, are also data inputs on the A side. In operation, the data on PA6 can be checked and if there is an indication that data is present, then the data on the other four lines decoded by the program.

The remaining signals are control signals for the adapter 109. The address line A3 is coupled into the chip select bit CS0 and it, along with $\overline{SEL13}$ coupled into the $\overline{CS2}$ bit, is used to select the adapter. The input CS1 is not used so it is coupled to plus 5 volts. The adapter includes four internal registers which are selected by the address bits A1 and A0 which are coupled into the inputs RS0 and RS1. Two of the registers are data registers. The other two are control registers which are not programmed.

Returning to FIG. 5, it can be seen that the signal SEL13 is used to select the I/O. Going then to Table A, it is seen that the addresses D008–D00B are assigned to PIA0. DIA0 is the adapter 109. This system has the capability of accepting additional PIAs which are not presently installed.

The remainder of the system, i.e., the microprocessor, which basically uses Motorola components, along with the memories, are connected in conventional fashion.

Figure 8:
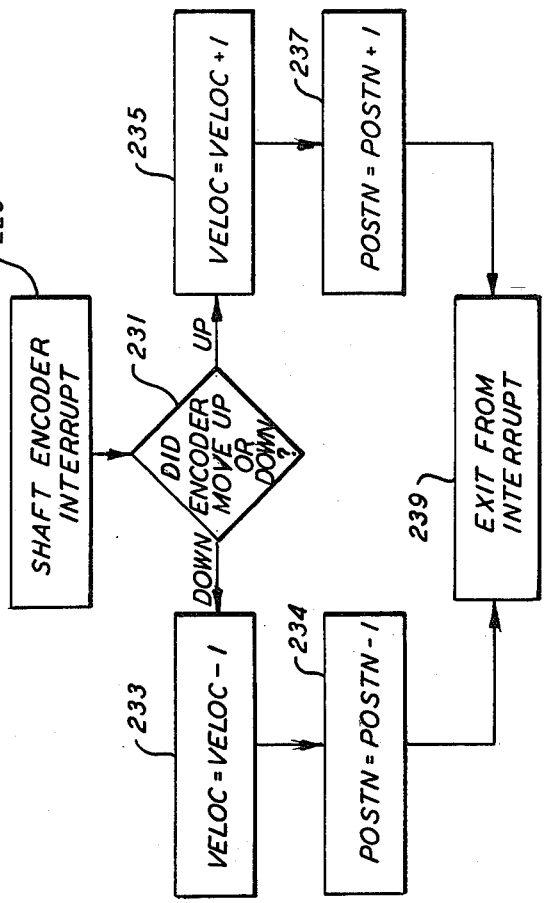
FIG. 8 is a flow diagram showing position and velocity monitoring in response to a shaft encoder interrupt.
Figure 7:
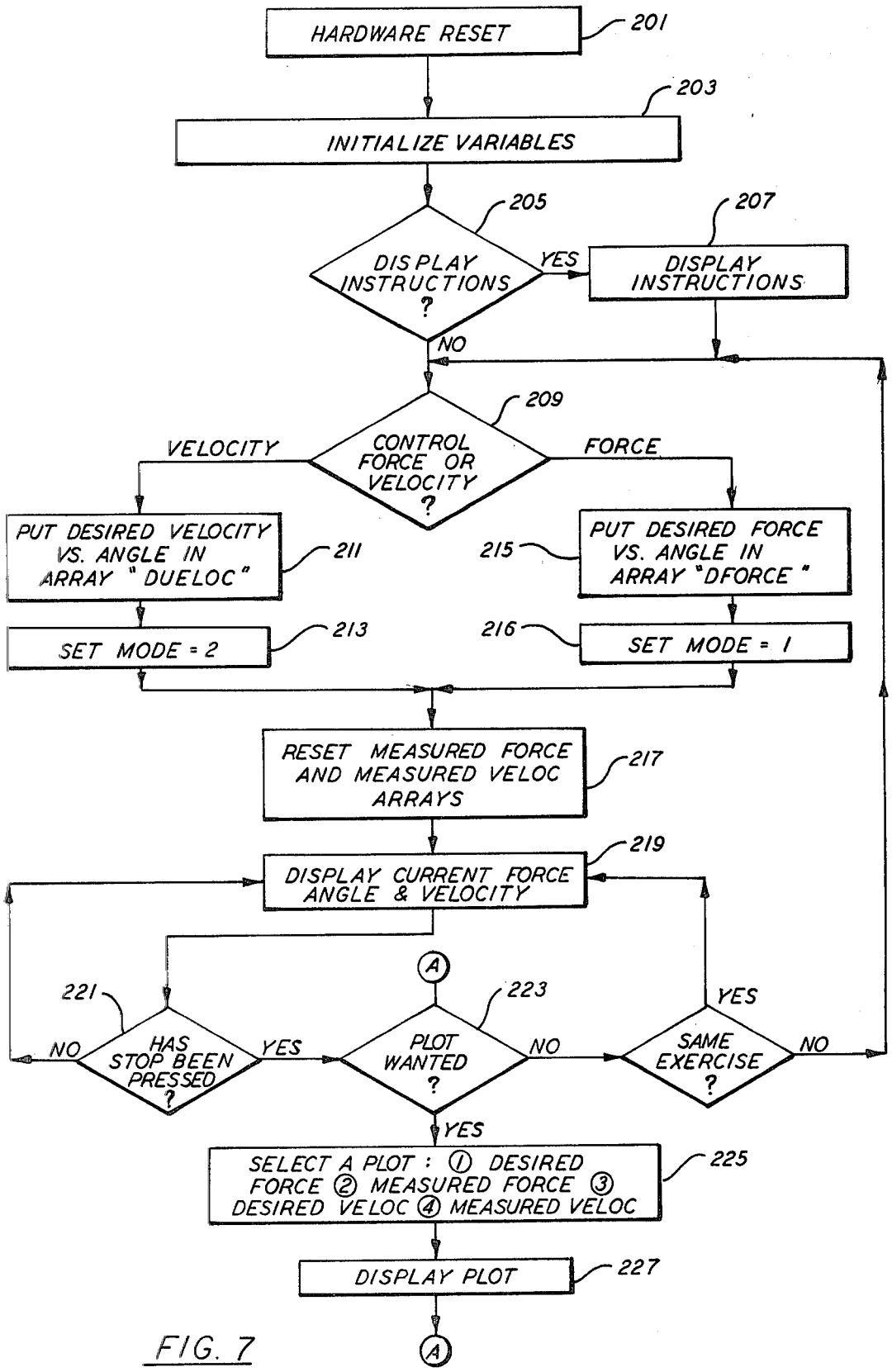
FIG. 7 is a flow diagram of the main program used in the microprocessor of FIG. 3.
Figure 9A:
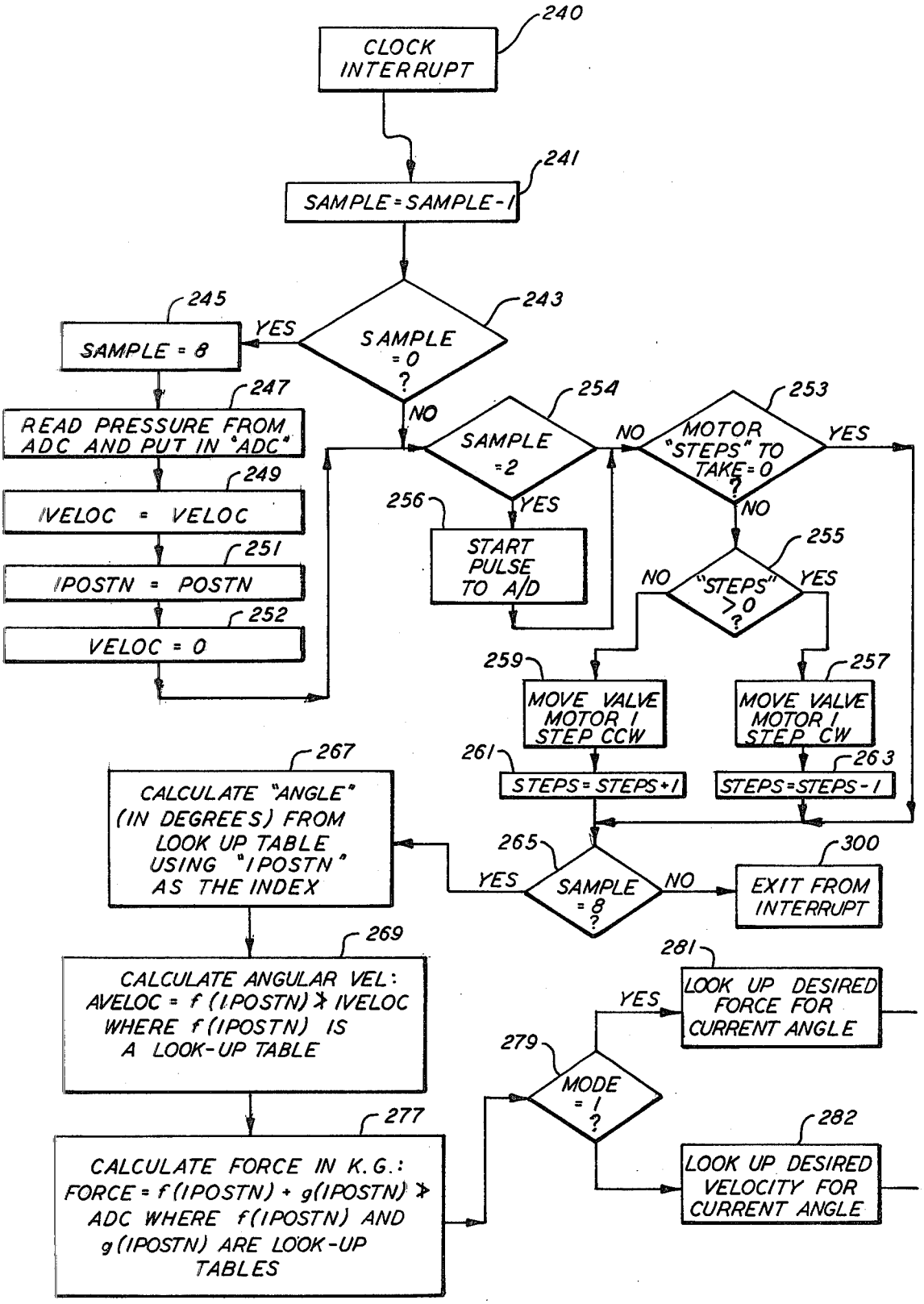
FIGS. 9A and B are flow diagrams showing the response of the computer program to a clock interrupt.
Figures 9, 9B:
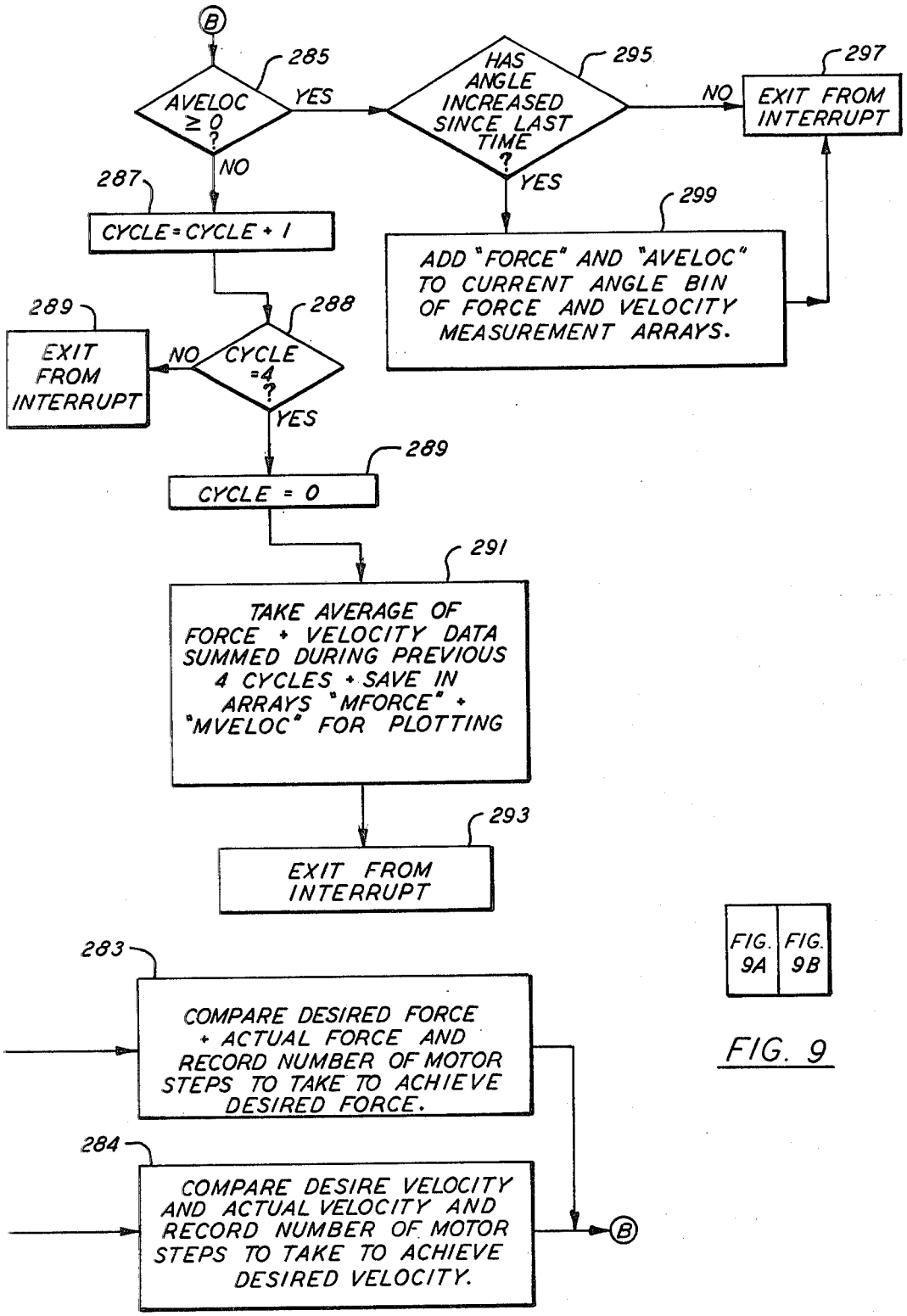

The manner in which the system operates can best be understood with reference to the flow charts of FIGS. 7–9.

Operation is started in the main program shown on FIG. 7 by pressing a hardward reset button as indicated in block 201. This pulls the reset line low, causing the restart address to be generated. It is assumed that the test/normal switch 159 of FIG. 3 is in the normal position. The first thing done is to initialize the variables as indicated by block 203. The various steps shown in the flow charts are setout in more detail in the program listing attached hereto. The program then enters a decision block 205 which asks if instructions should be displayed. This question is put on the alphanumeric display and asked to the user. If the user answers "yes", a block 207 is entered and instructions are displayed. This is done on the 20 character display and is scrolled using conventional techniques. The keyboard includes keys labelled 0 through 9, yes, no, enter, rub out, start and stop. If in response to the question "display instructions?", the user wanted instructions, he would hit "yes" and as indicated by block 207, the instructions would be displayed. The attached program and the flow chart of FIG. 7 are set up to permit controlling force or velocity. It should be noted that the system can also be programmed to control other parameters such as distance and acceleration. Once the instructions are displayed, which instructions give the user general information about the machine, or if the user, being familiar with the machine did not ask for instructions to be displayed, a decision block 209 is entered. Here the user is asked whether he wishes to control force or velocity. In addition, the program will ask information concerning what velocity and what force is desired. The attached program is set up to handle a constant force, constant velocity or a variable force and variable velocity in which the beginning value and ending value are specified. Reference to the program will show the exact questions that are asked. Specifically, the exercises just mentioned are given numbers so that the user is asked "Exercise number?", he can select Exercise, 1, 2, 3 or 4. If he selects the exercise where he specifies initial force and final force, then those questions will be asked. Otherwise, if he selects constant force, he will only be asked for one number. Similarly, he can select a single velocity or initial and final velocity.

Continuing with the flow diagram of FIG. 7, if velocity is selected then, in accordance with block 211, there is stored in memory an array of desired velocity versus angle. Thereafter, in block 213 the mode is set equal to 2 indicating velocity mode. Similarly, if force is selected, in accordance with block 215, an array of desired force versus angle is stored and the mode is set to 1 in accordance with block 216. Includes within the system are also measured force and measured velocity arrays. In accordance with the next block 217, these are zeroed or reset. At this point, instructions are given to the user that he may start the exercise; the specific instructions are set out in the program. During exercising, current force, angle and velocity are displayed as indicated by block 219.

After exiting this block, the program goes into a decision block 221 which asks if stop has been pressed. The exerciser has been told to press stop when he is finished. If he does not press stop, the program keeps looping back through block 219. Once stop has been pressed, a decision block 223 is entered, at which point the user is asked if he wants a plot. As noted above, the system can interface with any standard terminal. If a plot is selected, the answer is yes and the block 225 is entered. Here the user is given the choice of selecting a plot of desired force, measured force, desired velocity or measured velocity. This block is exited and the plot is displayed as indicated by block 227. The program exits from there back to the decision block 223 to see whether another plot is desired. When it is desired to do another exercise, hardware reset is pressed in accordance with block 201 and the program is gone through again. It should be noted that although the present program is set up to handle constant force and velocity or linearly changing forces and velocities, the capability is present to construct an arbitrary force or velocity curve. Similarly, other programs which provide constant or varible acceleration or which control the ranges of movement are also possible. For example, to generate a velocity which is variable with angle, it would only be necessary to input into each of the locations of the desired velocity array, a velocity desired at that angle. As presently set up, there are 120 locations in the array, each representing a half-degree in position, giving a range of roughly 60°. The information used for the plot of measured force and measured velocity is obtained from the measured force and measured velocity arrays which have a value recorded therein every half-degree. The program is presently set up so that four cycles of the exerciser are averaged for plotting purposes. Thus, normally after setting in the desired parameters, the person doing the exercise will go through the exercise four times before asking for a plot. A single cycle is not used because cycles can vary quite a bit from one to the other and it is felt that average values are better.

Another possibility is loading into the desired velocity or desired force curve what has been measured in the measured force or measured velocity curve. For example, if an athlete is trying to develop a certain type of motion for a certain sport, someone who is an expert in that sport can perform the movement on the exercising machine. His movement can then be stored and a trainee can then be asked to operate the machine using that stored information. This would then permit him to maximize the development of his muscles to obtain a velocity profile which would be most helpful in that particular sport. Other possibilities include additional programs to examine the measured velocity and force curves after each four exercises to determine whether or not the exerciser is tiring and to automatically decrease the severity of the exercise in accordance therewith. This permits exercising until completely fatigued. For example, if the exerciser initially set in a 50 pound force and after four cycles his velocity had slowed down considerably, the program could automatically reduce the force to 40 pounds and so on, permitting the excerciser to work against less and less force as he tired to get the maximum benefit from exercising. In contrast thereto, with present systems, for example with weights, it would be necessary to change the weights in order to do this.

As noted above, during the exercising the measured force and velocity is displayed along with the current angle. This gives immediate and positive feedback to the user and permits him to know immediately whether he is maintaining the force which he has set in for himself.

One important aspect of the system of the present invention is that it is impossible to have a force harder than the exerciser is pushing. The way the unit operates is that if the user is exerting, for example five pounds and he should be exerting twenty pounds, the hydraulic valve is closed down so that the user cannot use the bar unless he exerts the twenty pound force. However, he can always leave the bar still. The system insures as nearly as possible that the desired force is not exceeded. In this way, it becomes impossible to destroy the machine by exerting excess force. The only limitations on these controls are in the response time of the stepper motor which controls the hydraulic valve.

FIG. 8 illustrates the operation of the shaft Encoder interrupt. As indicated by block 229 the first thing to happen is that an interrupt occurs. A decision is then made in a decision block 231 whether the Encoder moved up or down. Depending on the answer to this question, the program either enters a block 233, where the velocity is decremented by 1, whereafter it enters a block 234 where the position is decremented by 1 or it enters a block 235 where the velocity is incremented by 1 or a block 237 where the position is incremented from 1. After leaving block 234 or 237, it exits from the interrupt as indicated by block 239. This interrupt is serviced whenever it occurs so that, wherever the main program is, it stops, services the interrupt and then returns to the main programming. What occurs in blocks 233, 234, 235 and 237 is simply the incrementing or decrementing of a counter. This is done to minimize the time spent in the interrupt. From this information and other information stored in the computer, such as time, the necessary calculations can then be carried out. As previously indicated, the shaft encoder only indicates the change in position. Thus, if the position becomes negative, it becomes known that the exerciser did not start at a zero position and the position is automatically set to zero. Position can be determined directly from the counter sincer it is known that each increment of position equals a certain amount of travel. Velocity, however, cannot. In order to measure velocity, the velocity counter is reset after a predetermined number of clock pulses and the value, before reset, saved, as the velocity over that interval. Thus, since the interval is about 1/15 of a second, it counts pulses for that time then stores the result and resets the counter.

The clock interrupt routine is illustrated on FIG. 9. In response to a clock interrupt 240, which is noted above, occurs about 15 times a second, a sample counter is decremented as indicated by block 241. A decision block 243 is then entered where a check is made to see if the sample is zero. If the sample is zero, in a block 245, the sample count is set to 8. Then, the pressure is read from the converter and loaded in an appropriate location as indicated by block 247. The instantaneous velocity is set equal to the quantity "velocity," the quantity which was indicated on FIG. 8, as indicated by block 249, i.e., this is the velocity which has been summed or integrated over the 8 samples. The position is updated to the current position as indicated in block 251, and velocity is then set to zero as indicated by block 252. The quantities IVELOC and IPOSTN are thus obtained. Either after exiting block 255, or if the sample number is not zero, a decision block 254 is entered. This block checks for sample equal to 2. If the answer is yes, block 250 is entered and the start pulse is sent to the analog to digital converter. From block 254 or block 256 the program enters decision block 253. This block determines how may steps there are for the motor to take. Since the motor cannot respond instantaneously, the motor is only moved one step per interrupt. If there are steps to take, the answer is no, and a decision block 255 is entered where a check is made to see if the number of steps is greater than zero. This in effect tells whether the steps must be clockwise or counterclockwise. If the steps are greater than zero and as indicated by block 257, the valve motor is moved one step clockwise. Otherwise as indicated by block 259, it is moved one step counterclockwise. After exiting these blocks the quantity "steps" is updated as indicated by blocks 261 and 263. In other words it is either incremented or decremented by one.

After exiting this portion of the program, a decision block 265 is entered where a check is made to see if the sample number is 8 indicating that this is the first pass through the program after resetting the sample number. If the answer is yes, the angle in degrees is calculated from a look-up table using "IPOSTN" as the index, as indicated in block 267. Then, angular velocity is calculated in accordance with block 269. Next, force in kilograms is calculated as indicated in block 271. Then, a decision block 279 is entered where a check is made to see what mode the system is in, i.e., mode one or mode two, a force mode or a velocity mode. If the mode is one, then the program looks up the desired force as indicated by block 281. If not mode one, i.e., mode, then block 282 is entered and the desired velocity is looked up for the current angle. Blocks 281 and 282 lead respectively to blocks 283 and 284 in which a comparison is made between the actual value and the desired value, and a number of motor steps necessary to reach the desired value calculated.

The program then goes to a decision block 285 where it determines whether the quantity AVELOC is equal to or greater than zero. This value is the calculated average velocity obtained in block 269. If the velocity is not greater than or equal to zero the answer is no, and the cycle is set equal to the previous cycle plus 1, as indicated by block 287. Next, a check is made to see if the cycle is equal to 4 in decision block 288. If it is not, then the interrupt is exited as indicated by block 289. If the answer is yes, the cycle is reset to zero as indicated by block 289, and thereafter the force and velocity of the four previous cycles is averaged as shown by block 291, whereafter the interrupt is exited as indicated by block 293. This is the averaging which is done for plotting purposes.

If the velocity is not greater than or equal to zero, the question is asked whether the angle has increased since the last time in block to 95. If the answer is 37 "no", the interrupt is exited as indicated by block to 297. If the answer is "yes", force and AVWLOC are added to the current force and velocity measurements as indicated by block 299 and again, the interrupt is exited. Returning back to decision block 265, if the sample is equal to 8 than an immediate exit occurs as indicated by block 300.

Examination of the flow chart will show that the pressure is read in every 8 samples, and that calculations are done every 8 sample times, except the averaging calculation which are done every 4 cycles. The only operation which is carried out every interrupt is that of stepping the motor, if necessary. Again, it is pointed out that such is required since the motor cannot respond quickly enough. Thus, the calculations in blocks 283 or 284 may require, for example, three or four steps of the motor. These will take place over the next three or four sampling intervals even though nothing else is being done.

In blocks 267, 269 and 277 it should be noted that calculations are done to determine velocity and to determine force. The calculation is done utilizing functions of position F[IPOSTN] G[IPOSTN]. These are obtained from look-up tables which are attached hereto. In the embodiment of the exerciser for which the present program was designed, the shaft encoded is not connected directly at the fulcrum but is coupled through a timing chain. This means that it does not accurately represent angle. A calculation was made of the relationship between angle at the shaft encode and angle at the point of rotation and utilized to construct a first look-up table. Similarly, there is another table which correlates encoder pulses to degrees. In this particular instance, one encoder pulse equals one half degree. These two calculations permit the use of the system of the present invention with any exerciser. In other words, these tables can be matched to any exercise machine taking into account its range of movement and any non-linearities between the shafting encoder output and movement of the machine. Furthermore, since the machne operates with a piston which is attached to the lever at some point other than the end where the force is applied by the user, there is a certain function involved between the pressure read out at the hydraulic cylinder and the pressure applied at the handles. This is the function G which contains a normalizing factor to convert the output of the pressure transducer into kilograms. The function G also corrects for varying angle between the exercise bar and the cylinder. It also takes into account the lever iron and the cylinder area when converting pressure to force at the exercise bar. Finally, there is a table, giving the function F which takes into account the weight of the exercise bar. The weight which the user experiences will depend on the angle of the exercise bar, i.e., when it is horizontal, the weight will be maximum, and when vertical, minimum. The function F takes this into account again in a look-up table.

Furthermore, note that the function of the decision block 285 is to either update the bin in the arrays for current measurements or to initiate the averaging which occurs at the end of a cycle. If the velocity is less than zero, it means that the bar is moving down and thus the cycle is over.

It should be noted that although plotting has been given as an example of how the data is taken out of the system, other possibilities exist. It is also possible to couple a record, e.g. a tape recorder or a disc recorder, to the computer and record a person's performance at an exercise session. This recorded information can then be used for analysis purposes and can furthermore be used to read back into the machine to ensure that he continues to increase the difficulty of his exercise from day to day.

A plurality of devices in accordance with the present invention can also be connected to a central computer under the control of an instructor who could immediately analyze incoming data which was transmitted from the exercise machines to the main computer. Furthermore, with such a tape or disc recorder pre-programed exercises can be provided. Previously, an example was given where a skilled athlete recorded a certain profile which was stored in current arrays and then transferred to the desired array. Similarly, such data, either from actual measurements on experienced athletes or through calculation can be recorded on a disc and the disc used as input to the system of the present invention. Similarly, the capability of exercising in accordance with previous data or stored data has great application in the area of rehabilitation where the force that can be applied in certain ranges of movement is limited.

What is claimed is:

1. An exerciser comprising:

(a) first means for engagement by at least one limb of a user, supported for movement between two limits;

(b) second means for controlling the movement of said first means by resisting a force applied thereagainst by the user, said means having a control input;

(c) third means for measuring the force applied to said first means by the user and providing a first output proportional thereto;

(d) fourth means for measuring the displacement of said first means between said limits and providing a second output proportional thereto; and (e) fifth, programmable means having as inputs said first and second output and providing a third output coupled as the control input to said second means.

2. An exerciser comprising:

(a) a frame;

(b) an exercise bar movably mounted on said frame for engagement by at lease one limb of a user, said exercise bar being movable between two limits;

(c) a hydraulic cylinder acting against said exercise bar in at least one direction to oppose a force applied by a user, said hydraulic cylinder including a control valve to control the flow of hydraulic fluid therein and thereby control the amount of resistance provided;

(d) means for measuring the pressure in said hydraulic cylinder to provide a first output which is a function of the force applied to said exercise bar;

(e) means for measuring the displacement of said exercise bar between said limits and for providing a second output proportional thereto;

(f) drive means for positioning the valve in said hydraulic cylinder; and (g) programmable means having as inputs said first and second outputs and providing a third output coupled as a control input to said drive means.

3. An exerciser according to claim 2 wherein said drive means comprises a stepper motor.

4. The exerciser according to claim 2 wherein said, programmable means include means to store an array of desired force values versus position; means responsive to said second output to select one of the stored values of force for comparison; and means to compare said selected value with said first output and to provide said third output in accordance with the differences therebetween.

5. The exerciser according to claim 2 wherein said, programmable means include means to store an array of desired velocity values as a function of position; means to derive from said second output a signal representative of velocity; means to select one of said stored values as a function of said second output; and means to compare said selected value with said signal and to provide a control output in accordance with the difference therebetween.

6. The exerciser according to claim 2 wherein said, programmable means include means to store an array of desired acceleration values as a function of position; means to derive from said second output a signal representative of acceleration; means to select one of said stored values as a function of said second output; and means to compare said selected value with said signal and to provide a control output in accordance with the difference therebetween.

7. An exerciser according to claim 2 wherein said exercise bar is rotatably mounted on said frame and said displacement measuring means is an angle encoder for measuring the angular displacement of the exercise bar.

8. An exerciser according to claim 2 wherein said control valve controls the rate at which hydraulic fluid is forced out of said hydraulic cylinder when the exercise bar is moved whereby the hydraulic cylinder provides passive resistance to a force applied by the user to the exercise bar.

9. An exerciser according to claim 8 wherein said drive means comprises a stepper motor which rotates in response to said control input to increase or decrease the rate at which hydraulic fluid is forced out of said hydraulic cylinder.

10. A method of operating an exerciser which includes: a frame, means for engagement by at least one limb of a user supported on said frame for rotation over an angular range; and an hydraulic cylinder acting against said means in at least one direction, said cylinder having an adjustable valve for controlling flow therethrough and thus the resistance to a force applied to said means for engagement by a user comprising:

(a) measuring the force applied to said means for engagement by measuring the pressure in said cylinder and providing a first output signal proportional thereto;
(b) measuring the angular displacement of said means for engagement and providing a second output signal proportional thereto;
(c) storing at least one desired valve;
(d) determining a measured value from at least one of said output signals;
(e) comparing said measured value with said desired value to develop a control signal indicative of the difference between said desired value and said one of said output signals; and
(f) using said control signal to automatically control said adjustable valve in a direction to bring said difference to zero.

11. The method according to claim 10 wherein said step of storing comprises storing a plurality of desired values as a function of angle and further including selecting as the desired value for said step of comparison a desired value representing the instantaneous angle as determined by said second output signal.

12. The method according to claim 11 wherein a plurality of desired values of force are stored as a function of angle.

13. The method according to claim 12 including determining from the change in said second output signal a measured value proportional to velocity.

14. The method according to claim 13 including storing a plurality of desired velocity values as a function of angle and, in accordance with a selection made by the user carrying out said step of comparison using one of said force values and velocity values.

15. The method according to claim 14 including storing, as a function of angle, said measured values in an array.

16. The method according to claim 15 wherein measured force values are stored.

17. The method according to claim 16 including compensating said measured force values for the weight of said means for engagement.

18. The method according to claim 17 and further including compensating said measured values for the location of said hydraulic cylinder.

19. The method according to claim 18 wherein said step of compensating includes compensating for the angle between said means for engagement and said hydraulic cylinder as a function of said second output signal.

20. The method according to claim 15 and further including averaging said measured values over four cycles and storing said average values in an array.

21. The method according to claim 20 and further including plotting said average measured values.

22. The method according to claim 20 and further including transferring said average measured values to a recording medium.

23. The method according to claim 20 and further including transferring said average measured values to another computer.

24. Apparatus according to claim 10 wherein said hydraulic cylinder is capable of applying force in only one direction and wherein said step of measuring said angular displacement comprises providing output pulses as a function of movement and counting said pulses to detemine angle, said determining further including resetting said count to zero when said means for engagement is at an end position.

25. The method according to claim 24 wherein said measurements of angle is obtained utilizing a shaft encoder and further including the step of determining now measured values of position and velocity as soon as input from said shaft encoder is detected.

26. The method according to claim 25 wherein said valve is automatically controlled by a stepper motor and wherein output pulses to said stepper motor are provided on the order of every fifteenth of a second if required.

27. A method of operating an exerciser which includes: a frame, limb engageable means for engagement by at least one limb of a user supported for movement on said frame, and force resisting means acting against said limb engageable means in at least one direction, said force resisting means being adjustable to control resistance to a force applied to said limb engageable means by a user comprising:

(a) measuring the force applied to said limb engageable means and providing a first output signal proportional thereto;
(b) measuring the displacement of said limb engageable means and providing a second output signal proportional thereto;
(c) storing at least one desired value of an operating parameter of said exerciser;
(d) determining a measured value of said parameter from at least one of said output signals;
(e) comparing said measured value with said desired value to develop a control signal indicative of the difference between said desired value and said least one of said output signals; and
(f) automatically controlling said force resisting means acting against said limb engageable means in a direction to bring said difference to zero using said control signal.

28. A method of operating an exerciser which includes a frame, limb-engaging means movably mounted on the frame for engagement by at least one limb of a user, force-resisting means acting against said limb-engaging means, said force-resisting means being adjustable to control resistance to a force applied by a user to said limb engaging means, comprising the steps of:

(a) moving the limb-engaging means a first time by applying a first user-exerted force to the limb-engaging means;
(b) measuring said first user-exerted force along the path of movement of the limb-engaging means and providing a first output signal proportional thereto;
(c) storing said first output signal;
(d) moving the limb-engaging means a second time by applying a second user-exerted force to the limb-engaging means;
(e) measuring said second user-exerted force along the path of movement of the limb-engaging means and providing a second output signal proportional thereto;
(f) comparing said second output signal with said stored first output signal to develop a control signal; and
(g) controlling said force-resisting means by said control signal.

29. The method according to claim 28 wherein said first and second user-exerted forces are measured at incremental points along the path of movement of the limb-engaging means.

30. A method of operating an exerciser which includes a frame, limb-engaging means movably mounted on the frame for engagement by at least one limb of a user, force-resisting means acting against said limb-engaging means, said force-resisting means being adjustable to control resistance to a force applied by a user to said limb-engaging means, comprising the steps of:

(a) moving the limb-engaging means a first time by applying a first user-exerted force to the limb-engaging means;

(b) measuring the displacement of the limb-engaging means along the path of movement of the limb-engaging means and providing a first output signal;

(c) storing said first output signal;

(d) moving the limb-engaging means a second time by applying a second user-exerted force to the limb-engaging means;

(e) measuring the displacement of the limb-engaging means along the path of movement of the limb-engaging means as the limb-engaging means is moved a second time and providing a second output signal;

(f) comparing said second output signal with said stored first output signal to develop a control signal; and (g) controlling said force-resisting means by said control signal.

31. The method according to claim 30 wherein the displacement of the limb-engaging means along the path of movement of the limb-engaging means is measured at incremental points along the path of movement.

32. The method according to claim 30 wherein said first output signal is proportional to the velocity of movement of the limb-engaging means as the limb-engaging means is moved said first time and said second output signal is proportional to the velocity of movement of the limb-engaging means as the limb-engaging means is moved said second time.

* * * * *